US006628259B2

(12) United States Patent
Hashimoto

(10) Patent No.: US 6,628,259 B2
(45) Date of Patent: Sep. 30, 2003

(54) DEVICE CIRCUIT OF DISPLAY UNIT

(75) Inventor: Yoshiharu Hashimoto, Tokyo (JP)

(73) Assignee: NEC Electronics Corporation, Kanagawa (JP)

( * ) Notice: Subject to any disclaimer, the term of this patent is extended or adjusted under 35 U.S.C. 154(b) by 403 days.

(21) Appl. No.: 09/782,311

(22) Filed: Feb. 14, 2001

(65) Prior Publication Data

US 2001/0015712 A1 Aug. 23, 2001

(30) Foreign Application Priority Data

Feb. 14, 2000 (JP) ..... 2000-034819

(51) Int. Cl.[7] ..... G09G 3/36
(52) U.S. Cl. ..... 345/98; 345/100
(58) Field of Search ..... 345/55–100, 204–206, 345/208, 209, 211–213

(56) References Cited

U.S. PATENT DOCUMENTS 6,191,768 B1 * 2/2001 Imamura ..... 345/98

FOREIGN PATENT DOCUMENTS

JP 05-216431 * 8/1993 ..... G09G/3/20
JP 8-329696 12/1996
JP 10-301536 * 11/1998 ..... G09G/3/36

* cited by examiner

*Primary Examiner*—Richard Hjerpe
*Assistant Examiner*—Alexander Eisen
(74) *Attorney, Agent, or Firm*—Young & Thompson

(57) ABSTRACT

A drive circuit of a display unit has a control circuit and a plurality of source drivers that are cascade-connected to each other. A start pulse signal is inputted into the source driver at the first stage and digital image data signals and clock signals are inputted into the source drivers at the respective stages from the control circuit. Clock signals are generated by a clock control circuit of the control circuit. For the clock signals, a reading period and a transferring period appear alternately, and the frequency of the low frequency clock pulse signal in the transferring period is lower than that of the high frequency clock pulse signal in the reading period. A shift register of the source driver transfer the start pulse signal to said source driver at the next source driver within one transferring period, and the start pulse signal is thus transferred in order from the source driver at the first stage up to the source driver at the final stage. Then, the source driver inputted the start pulse signal reads the digital image data signals in the reading period.

11 Claims, 11 Drawing Sheets

DEVICE CIRCUIT OF DISPLAY UNIT

BACKGROUND OF THE INVENTION

1. Field of the Invention

The present invention relates to a circuit for driving a display unit such as a liquid crystal display (LCD) for a personal computer (PC), and in particular, a drive circuit of a display unit in which clock signals are increased in speed.

2. Description of the Related Art

FIG. 1 is a circuit diagram showing a conventional general drive circuit of a display unit (hereinafter, referred to as a prior art 1). As shown in FIG. 1, a plurality of source lines 113 and a plurality of gate lines 116 are formed in LCD panel 105, and at the intersection of them, pixels using a TFT (a thin-film transistor) (not shown) as a switching device are arranged in a matrix form.

In FIG. 1, eight source driver LSIs (a display driver LSI) (hereinafter, referred to as a source driver) 103A through 103H to be connected to source lines 113 are arranged in a row, and four gate driver LSIs (hereinafter, referred to as gate drivers) 106 connected to the gate lines 116 are arranged in a column. These drivers comprise large scale integrated circuits (LSI).

Data is transmitted from PC (a personal computer) 100 to control circuit 101 of the liquid crystal module. Then, clock signals or the like are transmitted in parallel to the gate drivers 106 from the control circuit 101, a vertical synchronizing signal is transmitted to the first LSI of the gate drivers 106, and clock signals, digital image data signals, latch signals and others are transmitted to the source drivers 103A through 103H.

Then, at the point of time at which the TFT is turned ON by a positive voltage applied through the gate lines 116 from the gate drivers 106, a voltage applied through the source lines 113 from the source drivers charges liquid crystal load capacitance, and the TFT is turned OFF by a negative voltage applied through the gate lines 116 from the gate drivers 106, whereby the charged charge is held.

In a case where LCD panel 105 is an XGA (an extended Graphics Array) having 1024×768 pixels and a color type, the source lines 113 are 1024×3=3072 lines, so that eight source drivers having 384 outputs become necessary. Due to the limitation of the semiconductor manufacturing device, the size of each chip is approximately 20 mm, and in the case of the XGA, eight to ten source drivers become necessary. In addition, when it is unnecessary to distinguish the eight source drivers, the drivers are just called source drivers 103A through 103H, and in a case where it is necessary to distinguish the eight source drivers, source drivers at 1st through 8th stages are called the first through eighth source drivers 103A through 103H, respectively.

As mentioned above, clock signals, digital image data signals, latch signals are transmitted to the source drivers 103A through 103H from the control circuit 101 to control each of the source drivers.

On the other hand, a start pulse signal (SP) is transmitted to only the first source driver 103A at the first stage shown at the left end in FIG. 1 among the source drivers 103A through 103H from the control circuit 101. Then, the first source driver 103A operates to shift by the clock signal, synchronously, and selects a bit number for sampling data. After the first source driver 103A reads-in data, the start pulse signal is transferred to the second source driver 103B at the next stage (at the next on the right) from the first source driver 103A. Then, the start pulse signal operates the second source driver 103B in the same manner as the operation for the first source driver 103A. Thus, as shown by the arrows in FIG. 1, the start pulse signal is transferred from first source driver 103A to the eighth source driver 103H in order. Such connection is called cascade connection, and this has been generally used.

Next, unlike the abovementioned case, an example of a connection between source drivers LSIs and a control circuit, which is not the cascade connection, is described. FIG. 2 is a circuit diagram showing a control circuit and source drivers in a display unit which are not cascade-connected. As shown in FIG. 2, in the case where a plurality of source drivers 203 are not cascade-connected, wiring for clock signals, digital image data signals, latch signals and others are connected from control circuit 201 to the source drivers 203 in parallel. Therefore, the timings of the transmission of these signals to the source drivers 203 can be directly controlled by the control circuit 201. Therefore, the start pulse signal (SP) becomes unnecessary. However, in such a method, the number of wires increases, so that this case is not realistic.

FIG. 3 is a timing chart showing signals inputted into the source drivers in the circuit of the display unit having a plurality of source drivers that are cascade-connected to each other in prior art 1 shown in FIG. 1. Latch signal (STB), clock signal (CLK), digital image data signals (D00 to Dxx), and polarity signal (POL) of FIG. 3 are inputted into the source drivers 103A through 103H in the same manner, however, the start signal (SP) of FIG. 3 show the timing chart of the start pulse signal to be inputted into the first source driver 103A at the first stage of FIG. 1. The period between one rise and the next rise of the start pulse signal shows the period of transfer (1 horizontal period) of the start pulse signal (SP) inputted into the first source driver 103A at the first stage to the eighth source driver 103H at the final stage of FIG. 1. As shown in FIG. 3, conventionally, the clock signals (CLK) to be inputted into the source drivers 103A through 103H always have clock pulses of a fixed frequency. When the digital image data signals (D00 through Dxx) are read into memories (not shown) inside the source drivers from the source drivers to which the start pulse signal has been transferred, and the source drivers 103A through 103H read the digital image data corresponding to 1 horizontal period, the data read in synchronization with the latch signals (STB) is latched, digital-analog converted, and then outputted.

Recently, as in prior art 1 shown in FIG. 1, the LVDS (the Low Voltage Differential Signaling) method has been used for data transmission from the PC to the control circuit 101 of the module. The advantage in the use of this LVDS method is that high-rate transfer is possible and the EMI (the Electro Magnetic Interference) can be suppressed since the transfer is carried out at a low amplitude voltage.

In the future, data transfer at a high-rate and at a low amplitude voltage also becomes important between the control circuit 101 and the source drivers 103A through 103H in the display module.

That is, the clock signals from the PC are currently at approximately 70 MHz in an XGA panel, however, the signals are at 160 MHz or more in a UXGA panel with 1600×1200 pixels, and now, to double the frequency to be 320 MHz or more is being attempted.

However, in the abovementioned prior art 1 as shown in FIG. 3, the clock signal (CLK) always acts at a fixed frequency. Therefore, if the frequency of the clock signal increased, the action of the start pulse signal (SP) between the source drivers and transfer of the digital image data signals from the control circuit becomes unreliable.

The reason for this is because the transfer speed of the start pulse signal is limited to 200 MHz due to the use of CMOS interfaces between the source drivers. The internal functions of the source drivers stop until the start pulse signal is inputted. Even if the interfaces between the source drivers are improved, several nanoseconds (nsec) are required until the signals inside the source drivers, which have stopped, are started by the start pulse signal (SP). Therefore, the time for transferring the start pulse signal (SP) that is longer than the increased speed for the clock signal is required. However, the transfer time for the start pulse signal (SP), that is, the period from the input of the start pulse signal to the starting of the source drivers becomes impossible to secure in accordance with the increase in speed. Therefore, problems occur such that the digital image data signals are transmitted to the source drivers before the source drivers start operating. That is, the action of the start pulse signal (SP) to start the source drivers becomes unreliable.

A technology for correspondence with the clock signals at such a high frequency is disclosed in Japanese Patent Laid-Open Publication No.Hei.8-329696 (hereinafter, referred to as prior art 2). In prior art 2, a plurality of drivers are cascade-connected. The drivers include a multi-stage shift register, and lead-out outputs, which shift in order in synchronization with the input start signals, from each stage of the shift register. The drivers use the output start signals at the previous stage as input start signals, while the drivers generate signals, which are at a high level during a period corresponding to two periods of the clock signal, as output start signals by start signal generation circuits in response to the outputs from the previous stages before the final stage of the multi-stage shift register. Thereby, since the output start signals have times corresponding to the two pulse periods of clock signal, the drivers at the subsequent stages to which the output start signals are inputted can response at a desired timing even if the frequency of the clock signal increases. However, in the prior art 2, since the start signal generation circuits are provided for each driver, the unit becomes complicated.

SUMMARY OF THE INVENTION

It is an object of the present invention to provide a drive circuit of a display unit in which the transfer between the source drivers and the action for the source drivers of the start pulse signal are made reliable even if the speed of data transfer is increased in accordance with high speed clock signals.

A drive circuit of a display unit according to the present invention comprises a control circuit, source drivers and shift registers. Said display unit has transistors as switching devices, provided at intersections between a plurality of source lines and a plurality of gate lines intersecting the source lines, and display pixels arranged in a matrix form and controlled by the transistors. Image data outputted from the source lines is displayed in accordance with signals from the gate lines on the display pixels. The control circuit of the drive circuit generates a clock signal having a first clock pulse signal and a second clock pulse signal. The first clock pulse signal is generated in a reading period and the second clock pulse signal is generated in a transferring period. The reading period and the transferring period are alternately generated, and the frequency of the second clock pulse signal in the transferring period is lower than that of the first clock pulse signal in the reading period. The source drivers of the drive circuit are cascade-connected to each other at a plurality of stages. A start pulse signal is inputted into the source driver at the first stage, and the digital image data signals and the clock signals are inputted into the source drivers at each stage. The shift register provided in each of the source drivers transfers the start pulse signal to the source driver at the one-next stage per one transferring period so as to transfer the start pulse signals in order from the source driver at the first stage up to the source driver at the final stage. The source driver inputted into the start pulse signal reads the digital image data signal in the reading period.

In the driver circuit of the display unit according to the present invention, within the transferring period in which the clock signals to be inputted into the source drivers are low frequency clock pulse signals (a second clock pulse signal), the start pulse signal is transferred from one source driver to a source driver at the next stage, so that the start pulse signal can be securely transferred, and the period of time between the input of the start pulse signal and the starting of operation of the source driver can be reliably secured. Thus, since the control circuit generates clock signals that are low frequency clock pulse signals, the period of time from the input of the start pulse to the starting of the source driver's read-in operation can be reliably secured.

DETAILED DESCRIPTION OF THE PREFERRED EMBODIMENTS

Figure 4:
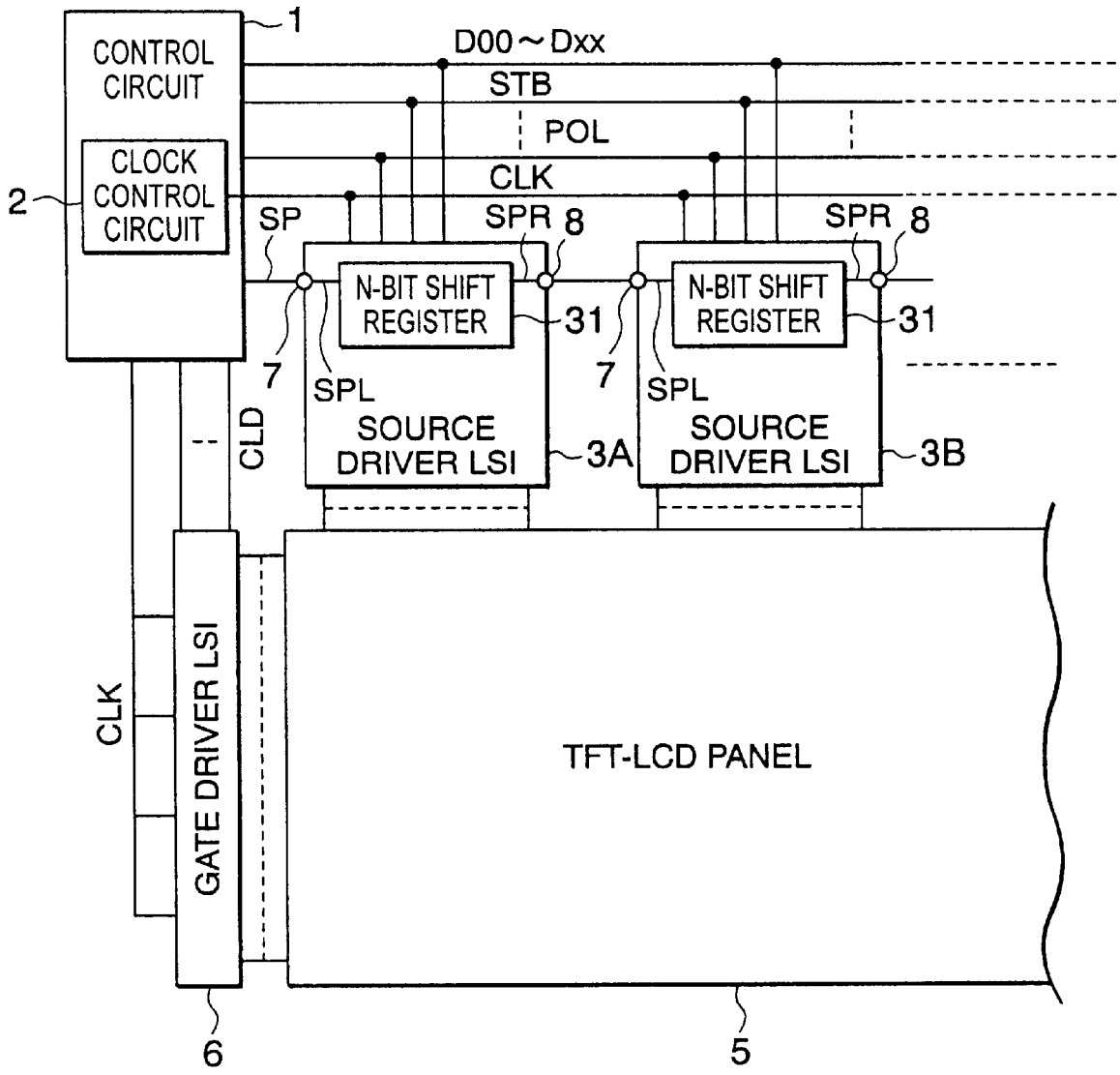
FIG. 4 is a circuit diagram showing a circuit of a display unit according to a first embodiment of the invention.

The preferred embodiments of the present invention are explained below with reference to the accompanying drawings. FIG. 4 is a circuit diagram showing a drive circuit of a display unit according to the first embodiment of the invention. In LCD panel 5, pixels are arranged in a matrix form while using a TFT as a switching device. A plurality of source drivers (a display driver) 3 are arranged along one end side in the direction of a row of the LCD panel 5. In FIG. 4, only source drivers 3A and 3B are illustrated, however, in the same manner as in FIG. 1, in actuality, 8 source drivers 3A through 3H are arranged. In addition, hereinafter, in a case where it is unnecessary to distinguish the 8 source drivers, the source drivers are referred to just as source drivers 3A through 3H, and in a case where it is necessary to distinguish the 8 source drivers, the source drivers at the 1st through 7th stages are referred to as the 1st through 7th source drivers 3A through 3G, and the source driver at the final stage is referred to as the 8th source driver 3H. The source drivers 3A through 3H comprise LSIs, and are cascade-connected to each other. Inside the source drivers 3A through 3H, N-bit shift registers 31 which select a bit number for sampling data are provided. On the other hand, gate driver 6 is provided along one end side in the direction of a column of the LCD panel 5. Although one gate driver 6 is illustrated in FIG. 4, a plurality of gate drivers comprising LSIs may be arranged as shown in FIG. 1.

Figure 1:
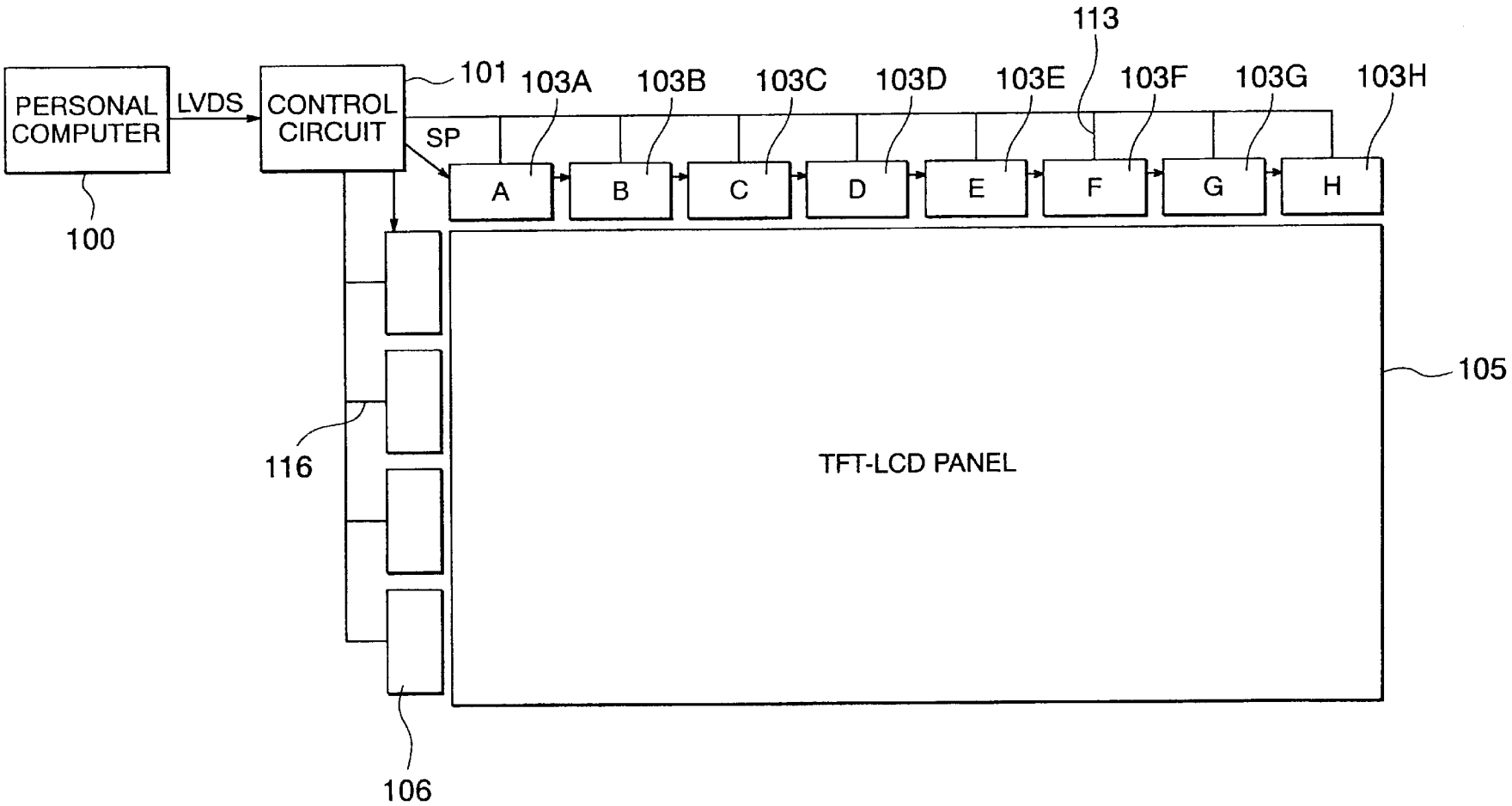
FIG. 1 (PRIOR ART)
FIG. 1 is a circuit diagram showing a drive circuit of a display unit of prior art 1.
Figure 2:
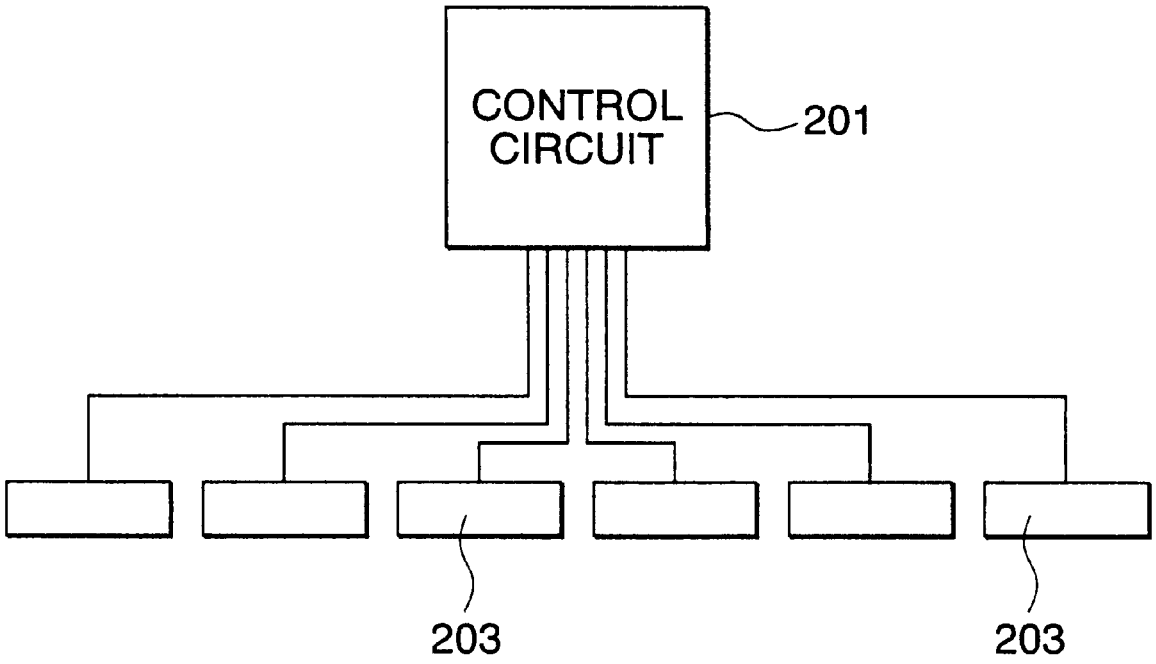
FIG. 2 (PRIOR ART)
FIG. 2 is a circuit diagram showing the control circuit and the plurality of source drivers in a case where the source drivers are not cascade-connected.
Figure 3:
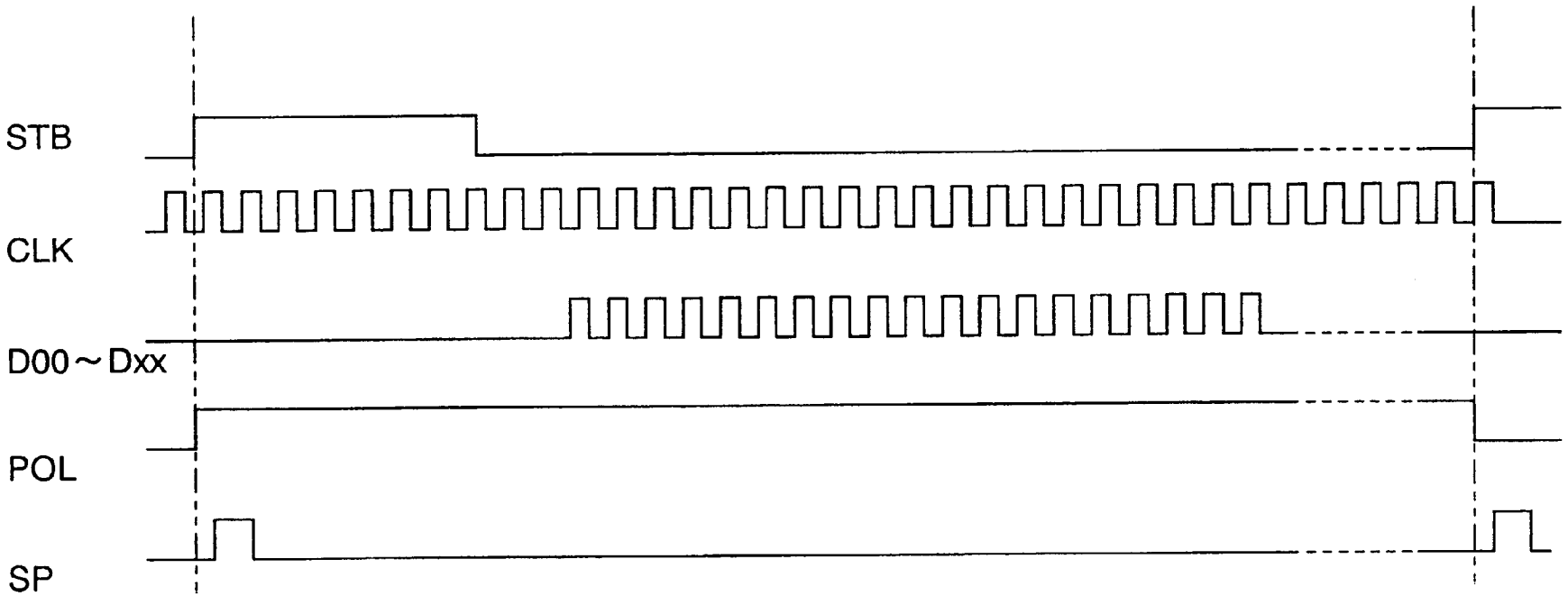
FIG. 3 (PRIOR ART)
FIG. 3 is a timing chart of the circuit of the display unit of FIG. 1.

In the present embodiment, as in the prior art 1 shown in FIG. 1, data is transmitted from, for example, an external PC (not shown) to the control circuit 1. Clock control circuit 2 is provided in the control circuit 1 to generate clock signals (CLK) to be transmitted to the source drivers 3A through 3H. Then, digital image data signals (D00 through Dxx), latch signals (STB), and polarity signals (POL) are transmitted to the source drivers 3A through 3H from the control circuit 1 in parallel. Furthermore, clock signals generated in the clock control circuit 2 in the control circuit 1 are transmitted to the source drivers 3 in parallel. In these clock signals (CLK), a high frequency period (a reading period) and a low frequency period (a transferring period) are alternately repeated, and a clock pulse signal at a high frequency (a first clock pulse signal) is generated in the high frequency period, and a clock pulse signal at a lower frequency (a second clock pulse signal) than the high frequency clock pulse signal is generated in the low frequency period. The periods of the high frequency clock pulse signal and the low frequency clock pulse signal are controlled by the clock control circuit 2, and a high frequency clock pulse signal is transmitted in the high frequency period and a low frequency clock pulse signal is transmitted in the low frequency period as clock signals to the source drivers 3A through 3H.

On the other hand, as in the prior arts mentioned above, the start pulse signal (SP) is transmitted to only the source driver at the first stage, that is, the first source driver 3A at the left end of FIG. 1 among the source drivers 3A through 3H from the control circuit 1, and is sequentially transferred up to the eighth source driver 3H at the final stage. Furthermore, in FIG. 4, and FIG. 6 and FIG. 9 which are described later, since the start pulse signal (SP) is inputted from SP input terminals 7 at the left sides of the source drivers 3A through 3H and outputted from SP output terminals 8 at the right sides of the source drivers, the start pulse signal (SP) inputted into the source drivers 3A through 3H is shown by SPL, and the start pulse signal (SP) outputted from the source drivers 3A through 3H is shown by SPR.

The start pulse signal (SP) for source drivers is inputted to the SP input terminal 7 of the first source driver 3A. The inputted start pulse signal SPL is transferred inside the first source driver 3A, and then outputted from the SP output terminal 8 as the start pulse signal SPR for the second source driver 3B. When the start pulse signal is inputted to the SP input terminal 7 of the first source driver 3A, the first source driver 3A executes a shift operation in accordance with the clock signal inputted into the first source driver 3A, and selects a bit number for sampling digital image data by the N-bit shift register 31. When the source driver 3A finishes reading of digital image data corresponding to N-bits (1 column), the start pulse signal (SPR) is outputted by the shift register 31. The start pulse signal SPR for the source driver outputted from the first source driver 3A is inputted to SP input terminal 7 of the second source driver 3B at the next stage as the start pulse signal SPL for the source driver. Thereafter, in the same manner as mentioned above, the start pulse signal SP for source drivers is transferred up to the eighth source driver 3H at the final stage in order while being shifted.

Also, clock signals at, for example, approximately 60 KHz are transmitted from the control circuit 1 to the gate drivers 6 in parallel, and vertical synchronizing signals (CLD) are inputted to the LSI at the first stage of the gate driver 6.

Figure 5A:
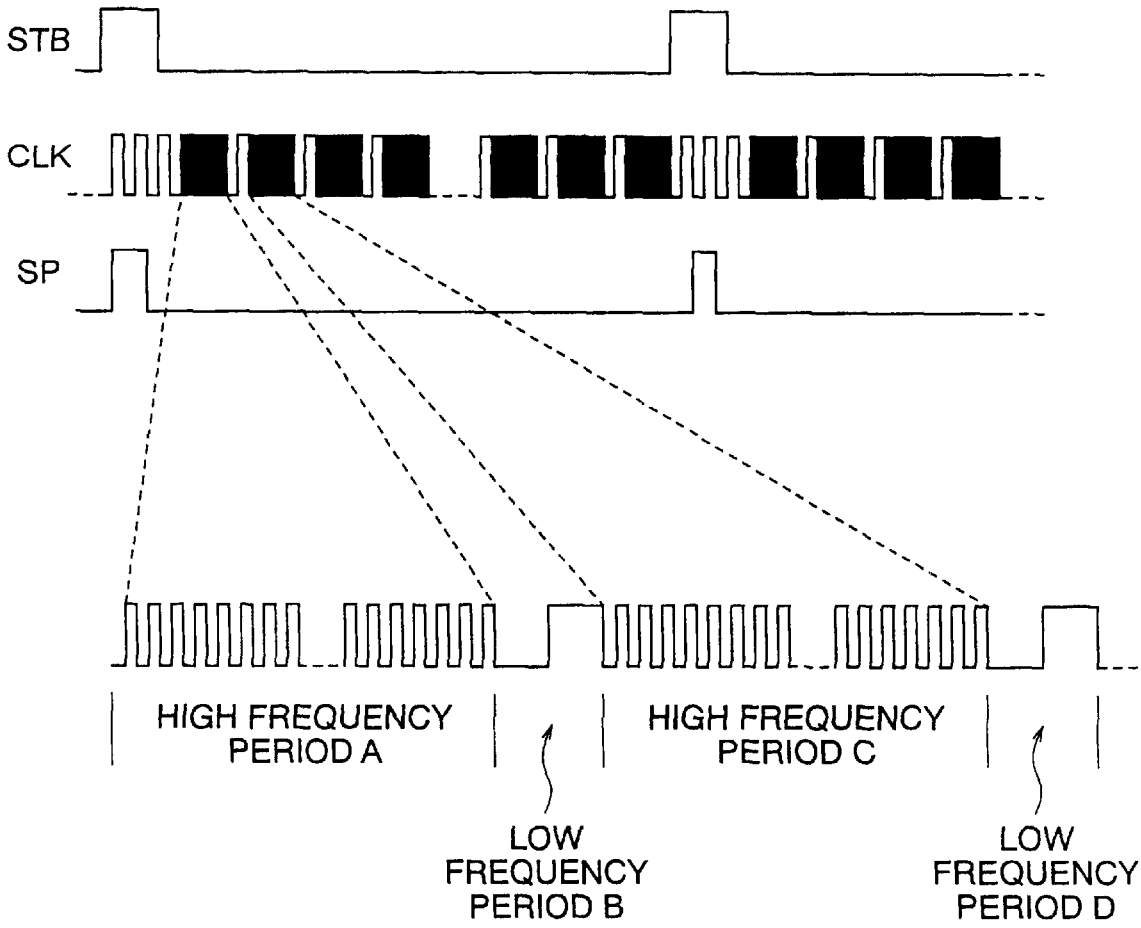
FIGS. 5A and 5B are timing charts of the circuit shown in FIG. 4.
Figure 5B:
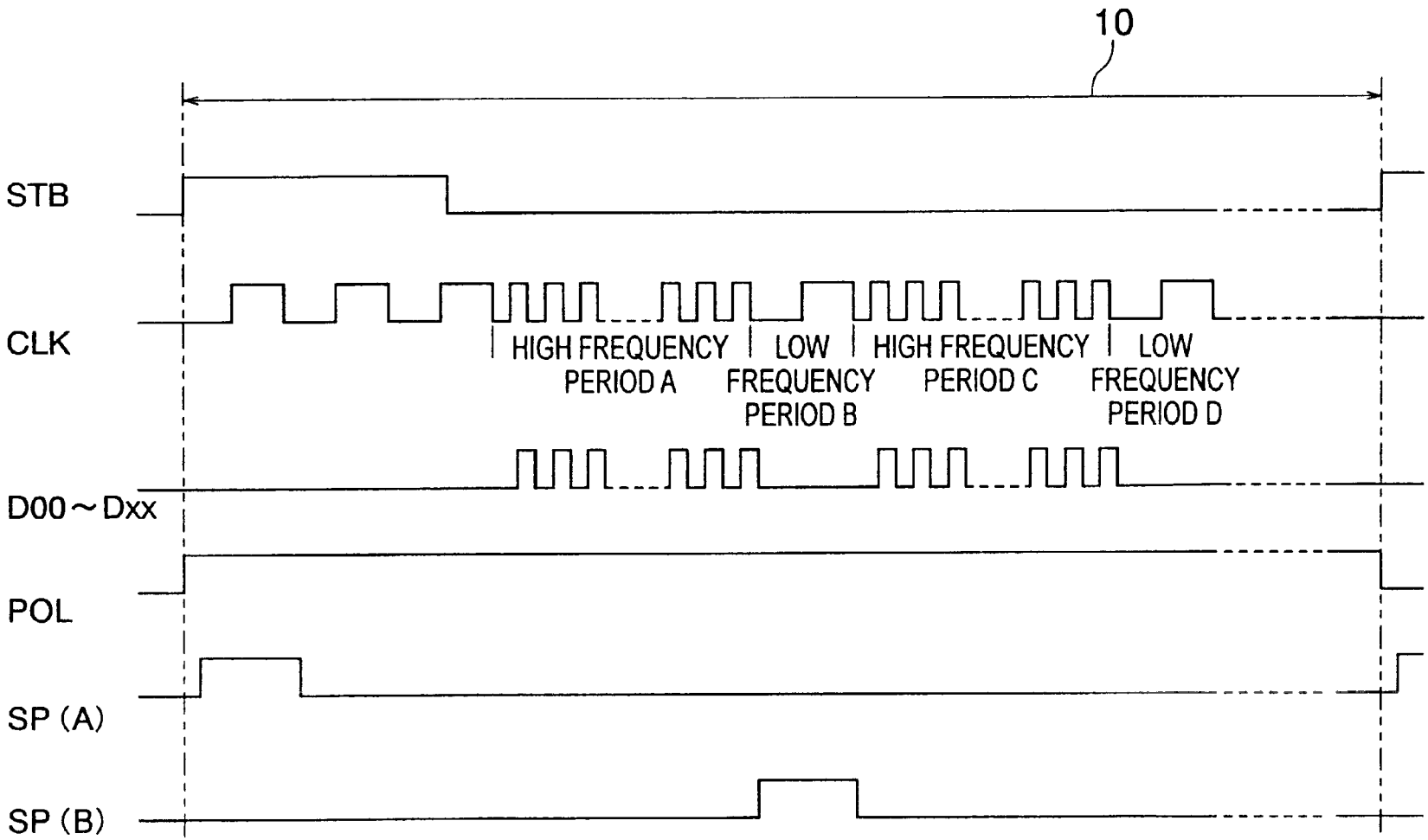

FIG. 5A is a timing chart showing the clock signal (CLK), start pulse signal (SP), and latch signal (STB) to be inputted into the source drivers of the present embodiment employing cascade connection, and FIG. 5B is a timing chart showing in an enlarged manner the latch signal (STB), clock signal (CLK), digital image data signal (D00 through Dxx), polarity signal (POL), and start pulse signal (SP) in the period in which the start pulse signal inputted into the first source driver 3A is transferred up to the eighth source driver 3H.

In FIG. 5B, the SP(A) and SP(B) show timing charts of the start pulse signal (SP) to be inputted into the SP input terminals 7 of the first source driver 3A and the second source driver 3B, respectively, and in FIG. 5A and FIG. 5B, the signals other than the start pulse signal (SP) are inputted into the source drivers 3A through 3H including the first source driver 3A.

As shown in FIG. 5A and FIG. 5B, during the 10 periods (1 horizontal period) from the rise of the start pulse of the start pulse signal SP(A) to the next rise, the start pulse inputted to the first source driver 3A is transferred up to the eight source driver 3H. CLK has high frequency periods A and C composed of high frequency clock pulse signals, and low frequency periods B and D composed of low frequency clock pulse signals, that are alternately repeated, and the frequency changes for each predetermined period. The digital image data signals (D00 through Dxx) are shown as clock pulse signal having the same pulse width as that of the high frequency clock pulse signal of CLK in FIG. 5B, however, in actuality, the digital image data signals have various pulse widths as necessary. The polarity signal (POL) go high or low every 10 periods.

Figure 6:
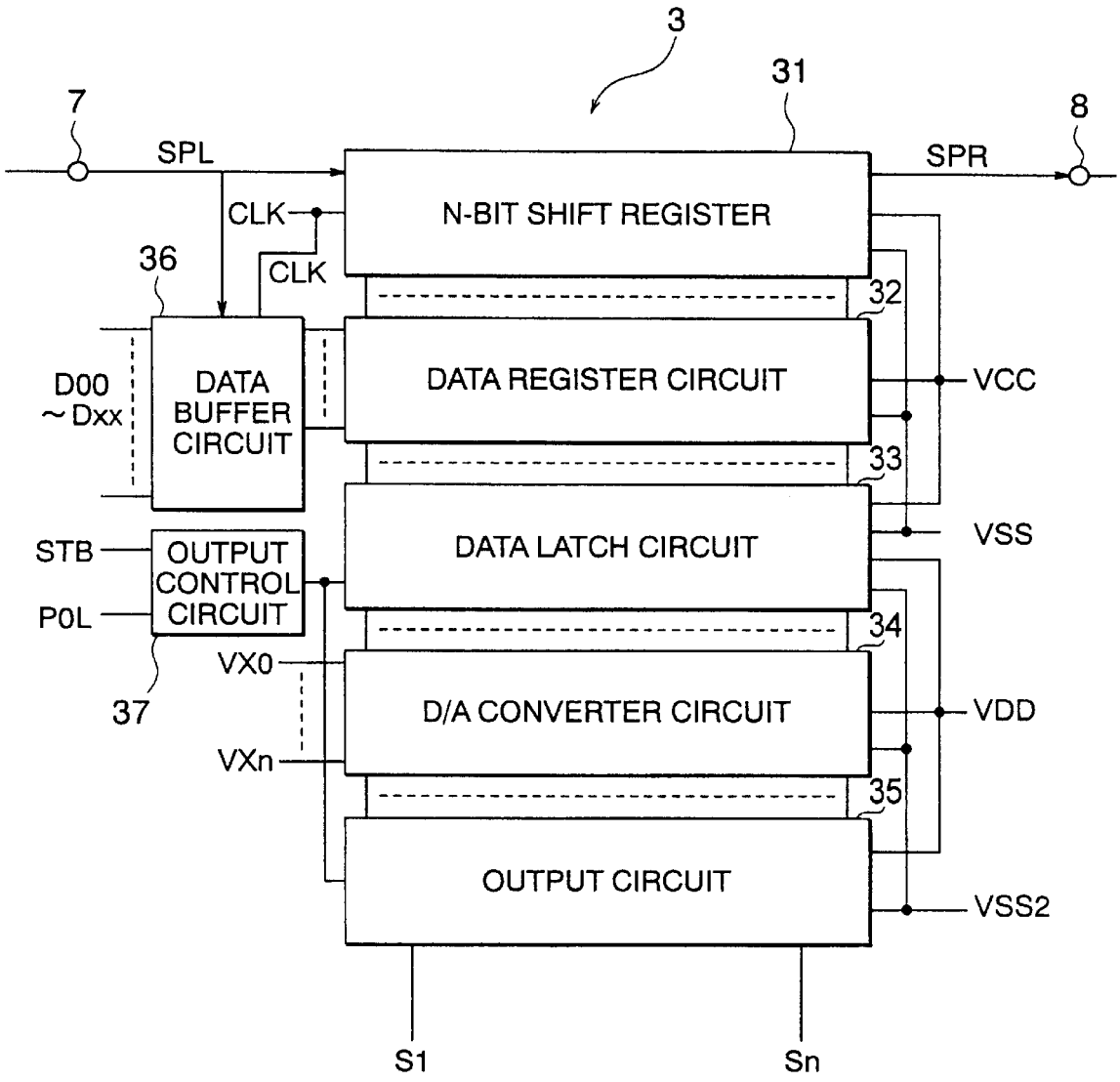
FIG. 6 is a circuit diagram showing the construction of the source driver.

Next, the construction of the source driver is explained. FIG. 6 is a circuit diagram showing the source driver of the present embodiment. As shown in FIG. 6, each of the source drivers 3A through 3H has N-bit shift register 31 to which the SPL is inputted from the SP input terminal 7. Data register circuit 32 is connected to the N-bit shift register 31. Data buffer circuit 36 and data latch circuit 33 are connected to the data register circuit 32, and D/A converter circuit 34 and output control circuit 37 are connected to the data latch circuit 33. Furthermore, output circuit 35 is connected to the D/A converter circuit 34 and the output control circuit 37.

The clock signal (CLK) and start pulse signal (SPL) are inputted into the N-bit shift register 31 from the SP input terminal 7, and the circuit 31 executes the shift operation during the high frequency period of the clock signal (CLK) and selects a bit number for sampling data. Then, the circuit 31 outputs the start pulse signal (SPR) to the SP output terminal 8. The start pulse signal (SPR) is transferred to the adjacent source driver at the next stage. The clock signal (CLK), digital image data signals (D00 through Dxx), and start pulse signal (SPL) are inputted into the data buffer circuit 36. Data from the data buffer circuit 36 is inputted into the data register circuit 32. The data latch circuit 33 temporarily latches the data from the data buffer circuit 36. Gradation voltages VX0 through VXn are externally inputted into the D/A converter circuit 34 to convert the digital data signals into analog signals. The output circuit 35 has an output buffer circuit (not shown), and the analog signals inputted from the D/A converter circuit 34 are amplified by the output buffer circuit and then outputted to the source lines S1 through Sn of the display unit (a LCD panel) 5. In the output control circuit 37, the latch signal (STB) and polarity signal (POL) are inputted, and the circuit inputs control signals into the data latch circuit 33 and the output circuit 35. Furthermore, the N-bit shift register 31, data register circuit 32, and data latch circuit 33 are connected to the high power line VCC and low power line VSS of the logic part, and the D/A converter circuit 34 and the output circuit 35 subsequent to the data latch circuit 33 (including the level shift circuit), are connected to the high power line VDD and low power line VSS2 of the driver part.

When the start pulse signal (SPL) is inputted, the data stop function of the data buffer circuit 36 is released. Then, during the high frequency period of the clock signal, the data buffer circuit reads-in digital image data (D00 through Dxx) of the bit number selected by the N-bit shift register 31. The operation of the data buffer circuit 36 automatically stops when a predetermined number of pulses in the high frequency clock pulse signal are inputted. Then, during the low frequency period of the clock signal, the transfer period is entered in which the start pulse signal (SPR) is transferred to the source driver at the next stage. When the start pulse signal is transferred up to the final stage and digital image data corresponding to one horizontal period is read, the digital image data of the data register circuit 32 is latched by the data latch circuit 33, converted into analog data by the D/A converter circuit 34, and then outputted from the output terminals S1 through Sn of the output circuit 35. The data register circuit 32 reads-in digital image data signals corresponding to the next horizontal period until the read-in digital image data is outputted from the data latch circuit 33.

Figure 7A:
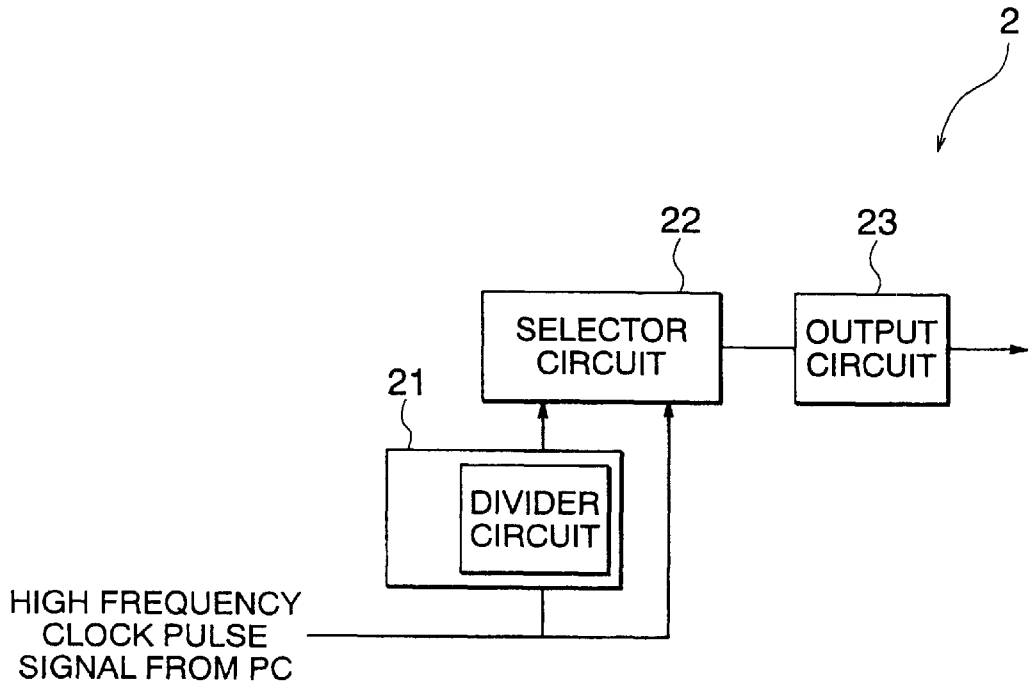
FIGS. 7A and 7B are a circuit diagrams showing the clock control circuit of FIG. 4.
Figure 7B:
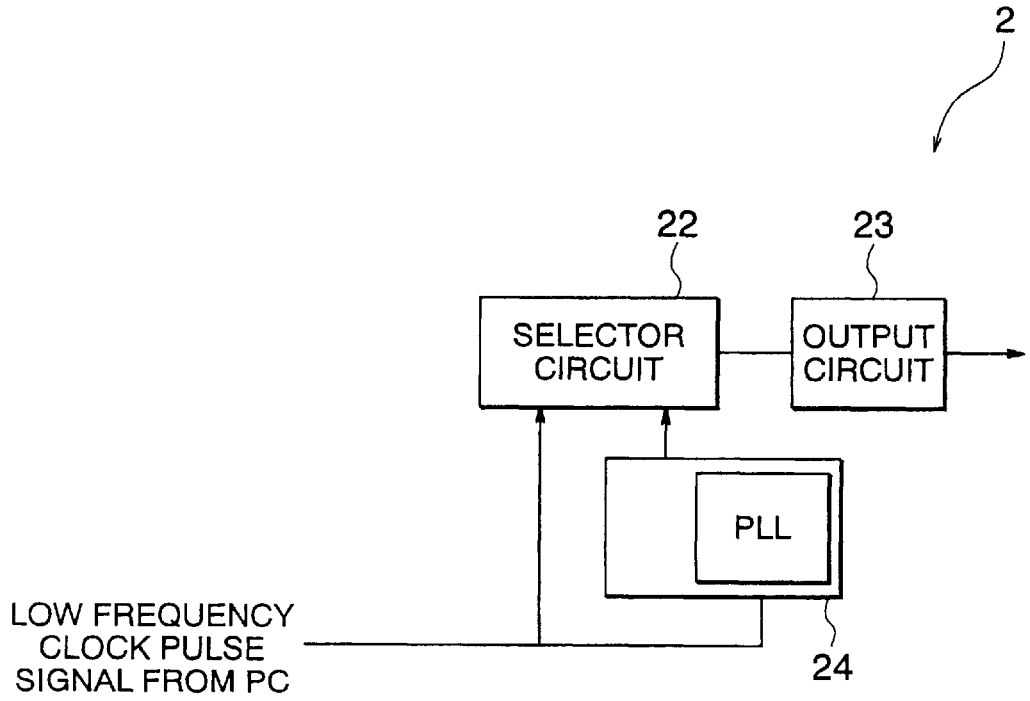

Next, the clock control circuit of the present embodiment is explained. FIG. 7A and FIG. 7B are circuit diagrams showing the clock control circuit 2 of FIG. 4. FIG. 7A shows the case where a high frequency clock pulse signal is transmitted from the PC, and FIG. 7B shows the case where a low frequency clock pulse signal is transmitted from the PC.

As shown in FIG. 7A, in the case where the high frequency clock pulse signal is transmitted from the PC, the clock control circuit has frequency lowering circuit 21 having a divider circuit, and the high frequency clock pulse signal is inputted into the frequency lowering circuit 21 from the PC, and in the circuit 21, the frequency is converted to output a low frequency clock pulse signal. Then, the low frequency clock pulse signal obtained by the frequency lowering circuit 21 and the high frequency clock pulse signal transmitted from the PC are inputted into selector circuit 22. Thereafter, either one of the low frequency clock pulse signal or the high frequency clock pulse signal is selected by the selector circuit 22 and outputted from the output circuit 23 as a clock signal.

Furthermore, as shown in FIG. 7B, in the case where a low frequency clock pulse signal is transmitted from the PC, the clock control circuit has frequency raising circuit 24 having PLL. A low frequency clock pulse signal is inputted into the frequency raising circuit 24, and the frequency is converted in the circuit 24 to output a high frequency clock pulse signal. Then, the high frequency clock pulse signal obtained from the frequency raising circuit 24 and the low frequency clock pulse signal which has not changed since it was transmitted from the PC, are inputted into the selector circuit 22. Thereafter, either one of the low frequency pulse or the high frequency pulse is selected by the selector circuit 22 and outputted from the output circuit 23 as a clock signal.

Moreover, by providing frequency raising circuit 24 in FIG. 7A, the high frequency clock pulse signal transmitted from the PC or the like may be converted into a higher frequency clock pulse signal and inputted into the selector circuit 22. Or, by providing frequency lowering circuit 21 in FIG. 7B, and the low frequency clock pulse signal transmitted from the PC or the like may be converted into a lower frequency clock pulse signal and inputted into the selector circuit 22.

In all cases, either one of the lower frequency clock pulse signal or the high frequency clock pulse signal is selected, outputted from the output circuit 23 within a predetermined output period, and the high frequency clock pulse signal composes the high frequency periods A and C of the clock signals, and the low frequency clock pulse signal composes the low frequency periods B and D of the clock signals as shown in FIG. 5.

Next, the operation of the display unit according to the present embodiment is explained. The source drivers 3A through 3H generate internal signals such as clock signal, data signal and others inside, and in synchronization with these internal signals, the source drivers execute a read-in operation of the digital image data signals from the control circuit 1. However, until the start pulse signal is transferred, the read-in operation is stopped by an internal operation stop function for stopping generation of internal signals including internal clock signal and others and stopping the data read-in operation. First, when the start pulse signal (SP) is inputted from the control circuit 1 into the first source driver 3A at the first stage, the internal operation stop function of the first source driver 3A is released. Then, internal signals are generated in the first source driver 3A within the high frequency period A in which the clock signal becomes a high frequency clock pulse signal, and the first source driver receives the digital image data signals from the control circuit 1. Thus, the first source driver 3A executes the read-in operation, and receives digital image data signals corresponding to 384 outputs from the control circuit 1. Thereby, the clock signal enters the low frequency period B of low frequency clock pulse signal, and the start pulse signal (SP) is outputted from the first source driver 3A to the second source driver 3B at the next stage within the low frequency period B. Thus, the start pulse signal (SP) is transferred. After this, the internal operation stop function of the second source driver 3B to which the start pulse signal (SP) has been transferred is released. Then, the second source driver 3B reads-in the digital image data signals from the control circuit 1 within the high frequency period C in which the clock signal is composed of high frequency clock pulse signal. During this, the internal operation stop function of the first source driver 3A acts and stops the operation of the source driver 3A. Thus, when the signals including digital image data signals and others are transferred and the operation for reading the digital image data signals is finished, the source drivers 3A through 3H automatically stop the internal operation function for generating internal signals. Thereby, the power consumption lowers. The second source driver 3B receives data corresponding to 384 outputs from the control circuit 1 within the high frequency period C of the clock signal, and then executes the data read-in operation. At this time, the clock signal become low frequency clock pulse signal again, and in the low frequency period D, the start pulse signal (SP) is transferred from the second source driver 3B to the third source driver 3C at the next stage. Subsequently, the same operations are repeated up to the eighth source driver 3H at the final stage. At the point of time at which the source driver 3H at the final stage completes the read-in operation of the digital image data signals, the internal function for generating the internal clock signals, internal data signals, and others to operate is stopped in all source drivers 3A through 3H. Then, by transferring the start pulse signal (SP) to the first source driver 3A at the first stage from the control circuit again, the same operations as mentioned above are started.

In the present embodiment, in a case where the EMI noise does not become a serious problem in the control circuit 1 and between the source drivers 3A through 3H, the clock signals and digital image signals can be outputted in the waveform with the VCC-VSS amplitude by output buffers of the high potential power line (VCC) and the low potential power line (VSS) in the same way as other signals including latch signals, polarity signals, start pulse signals, vertical synchronizing signals, horizontal synchronizing signals, and others. When the start pulse signal is transferred between a plurality of cascade-connected source drivers, clock signals are reduced in speed, so that reliable transfer of the start pulse signal becomes possible, and furthermore, stable operations are guaranteed since the period of time until the internal clock stop function of the source drivers is released can be reliably secured.

Next, the second embodiment of the present invention is explained. This embodiment can be applied to the case where the EMI noise becomes a problem in the first embodiment.

In accordance with an increase in speed, due to the transfer of clock signals and digital image data signals at a low amplitude voltage, it becomes necessary for the EMI between the control circuit and the source drivers to be further suppressed. This is because the radiation level of the EMI is in proportion to the square of the voltage of the signals propagated in the wiring lines.

In the abovementioned prior arts, the clock signals and digital image data signals cannot be transferred at a predetermined low amplitude voltage. This is because the output buffer of the control circuit in the prior arts is composed of only the high potential line VCC and the low potential line VSS. Therefore, the amplitudes of the clock signals (CLK) and digital image data signals (D00 through Dxx) are determined by the VCC-VSS in the same manner as the amplitudes of other signals including the vertical synchronizing signals, horizontal synchronizing signals, polarity signals, the start pulse signals (SP), or the like. That is, the H levels of the clock signals and digital image signals are fixed by the VCC, and the L levels thereof are fixed by the VSS.

Furthermore, conventionally, as the lowered amplitude voltage as a countermeasure for the EMI, there is a method for intently moderating the waveform by inserting a filter at the output side of the output buffer of the VCC-VSS. However, in this method, the digital image data signals may be different in time delay from the clock signals depending on data in some cases, so that the set-up time and hold time required for the source drivers in accordance with speedup of the clock signals become shorter, and this is a problem of design.

The present embodiment provides a circuit of a display unit, wherein the transfer of the start pulse signal (SP) between the source drivers and its action are reliably executed even when the operating speed becomes high, and the EMI noise between the control circuit and the source drivers is suppressed without causing a difference in time delay depending on the data.

Figure 8A:
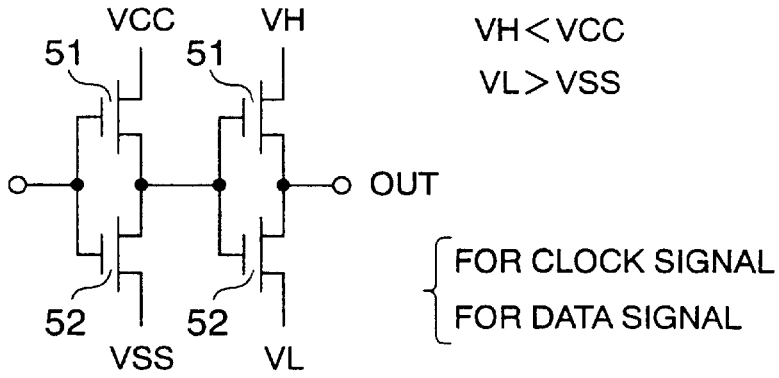
FIGS. 8A–8D are circuit diagrams showing the output buffers of a second embodiment of the invention.
Figure 8B:
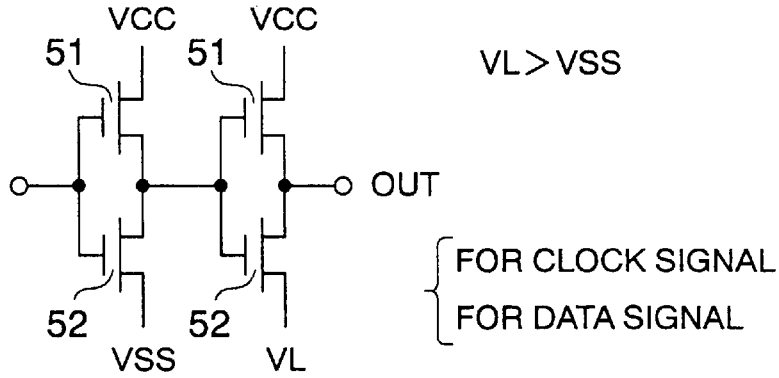
Figure 8C:
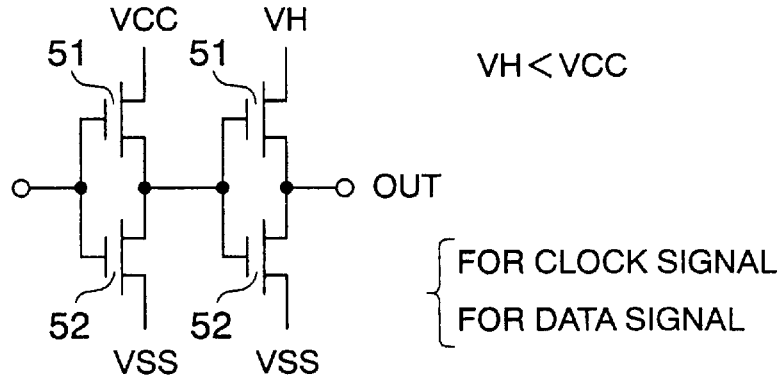
Figure 8D:
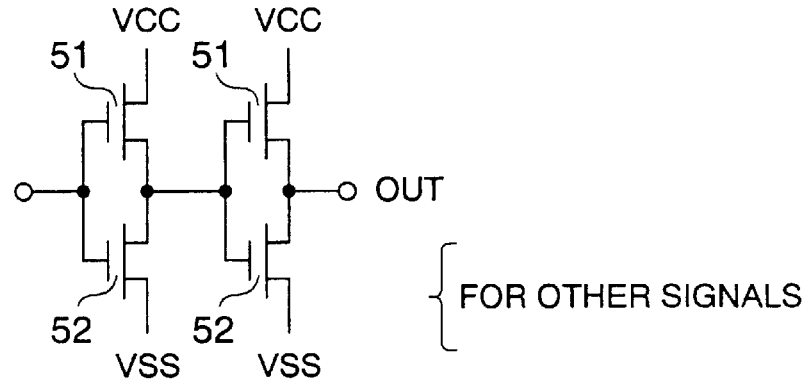

FIG. 8A through FIG. 8D are circuit diagrams showing the output circuits (output buffer circuits) of the clock control circuit provided within the control circuit. Other points in construction are the same as in the first embodiment. As shown in FIG. 8A through FIG. 8D, the output buffer circuit is constructed from inverters connected by an even number of stages in each of which a P-channel field effect transistor 51 and an N-channel field effect transistor 52 are connected in series. FIG. 8A through FIG. 8D show examples in which such inverters are connected by two stages. FIG. 8A through FIG. 8C illustrate output circuits to be used for the clock signals and digital image data signals of the present embodiment, and FIG. 8D illustrates an output circuit to be used for signals other than the clock signals and the digital image data signals.

FIG. 8A shows an example in which a VH line and a VL line are provided in addition to the VCC line and the VSS line. The potential relationship between the lines is expressed as VCC>VH>VL>VSS.

Then, the output buffer circuit shown in FIG. 8A is formed, and this circuit is used as the output buffer for clock signals and digital image data signals. That is, the output buffer of FIG. 8A is used in the output circuit 23 of FIG. 7. Since the frequencies of the latch signals, polarity signals, start pulse signal, and vertical synchronizing signals, horizontal synchronizing signals, and other signals are low, for example, the latch signal (STB) for transferring the image data has a frequency of approximately 60 KHz, the output buffer having a high amplitude of VCC-VSS shown in FIG. 8D is used for the signals as in the prior arts.

Thereby, the waveforms of the clock signals and the digital image data signals have a low amplitude of VH-VL, so that the EMI noise can be suppressed.

Furthermore, by providing a VL line in addition to the VCC line and VSS line (VCC>VL>VSS) to form the output buffer shown in FIG. 8B, and this buffer may be used as the output buffer for the clock signals and the digital image data signals. The amplitudes of the waveforms of the clock signals and the digital image data signals become VCC-VL that is lower than VCC-VSS, so that the EMI noise can be suppressed more than in the prior arts.

Moreover, by providing a VH line in addition to the VCC line and VSS line (VCC>VH>VSS) to form the output buffer shown in FIG. 8C, and this buffer may be used as the output buffer for the clock signals and digital image data signals. The amplitudes of the waveforms of the clock signals and the digital image data signals become VH-VSS that is lower than VCC-VSS, so that the EMI noise can be suppressed more than in the prior arts.

Figure 9:
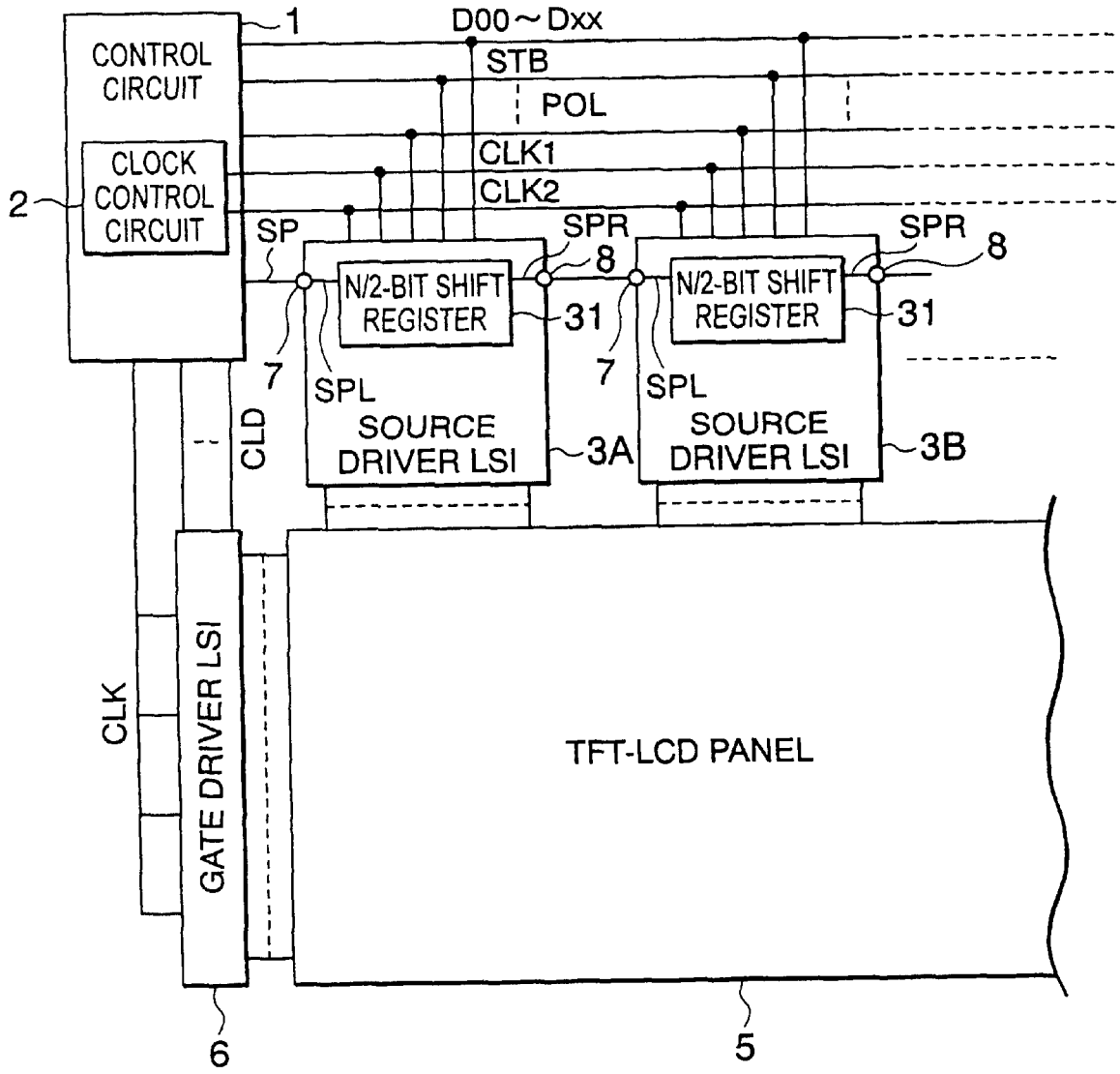
FIG. 9 is a circuit diagram showing the circuit of a display unit of a third embodiment of the invention.
Figure 10:
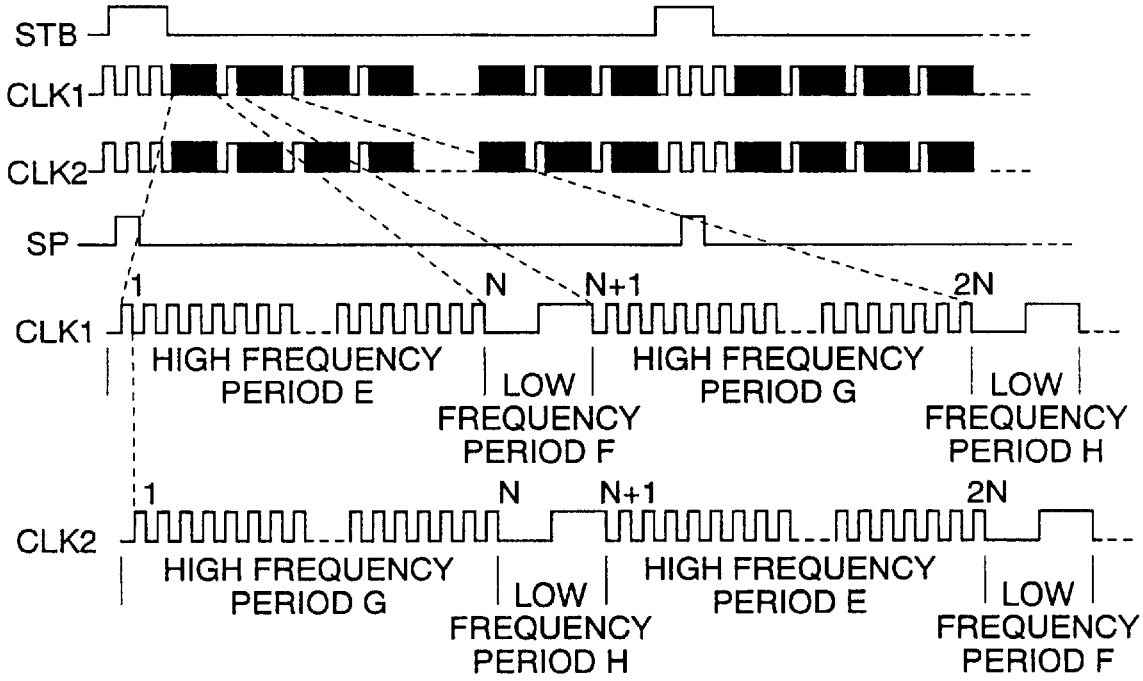
FIG. 10 is a timing chart of FIG. 9.

Next, the third embodiment of the invention shown in FIG. 9 and FIG. 10 is explained. The components that are the same as or similar to that in the first embodiment shown in FIG. 4 through FIG. 7 have the same symbols attached to them, and detailed description thereof is omitted.

In the present embodiment, as a EMI countermeasure, two CLK 1 and CLK 2 whose phases are different from each other by 90 degrees are used, and N/2-bit shift register 31 is used for the source drivers 3A though 3H. Also, in the present embodiment, these two clock signals CLK 1 and CLK2 have high frequency periods E and G consisting of high frequency clock pulse signals and low frequency periods F and H consisting of low frequency clock pulse signals, and the frequencies of the signals change in a predetermined cycle.

Also, in the present embodiment, as in the first embodiment, a plurality of source drivers (a display driver) are used, and when a start pulse signal (SP) is transferred between the cascade-connected source drivers, since the clock signal is lowered in speed, the reliable transfer of the start pulse signal becomes possible, and the time until the internal clock stop function of each source driver can be reliably secured. Therefore, stable operations of the source drivers are guaranteed. Furthermore, a plurality of clock signal lines for inputting signals from the clock control circuit 2 into the source drivers are used, whereby higher accuracy and further miniaturization are realized. In addition, in the present invention, the output buffer circuit that is the same as in the second embodiment is also provided, and the voltage amplitudes of the clock signals and digital image data signals are lowered, whereby the EMI noise can be suppressed.

What is claimed is:

1. A drive circuit of a display unit which has a plurality of source lines and gate lines, transistors provided as switching devices at intersections between the gate lines and the source lines, and display pixels arranged in a matrix form to be controlled by the transistors, wherein image data outputted from the source lines is displayed in accordance with signals from the gate lines on the display pixels, comprising:

a control circuit for generating a clock signal consisting of a first clock pulse signal and a second clock pulse signal, in which a reading period when said first clock pulse signal is generated and a transferring period when said second clock pulse signal is generated appear alternately, and the frequency of said second clock pulse signal in the transferring period is lower than that of said first clock pulse signal in the reading period;

source drivers being cascade-connected at a plurality of stages, in which the source driver at a first stage is inputted a start pulse signal, and the source drivers at respective steps are inputted digital image data signals and the clock signals, and the source driver in which the start pulse signal is inputted reads the digital image data signal in the reading period; and a shift register provided in each of the source drivers, transferring the start pulse signal during the transferring period toward the source driver at one next stage per one transferring period so as to transfer the start pulse signal in order from the source driver at the first stage up to the source driver at the final stage.

2. The drive circuit of a display unit according to claim 1, wherein said source driver automatically stops the operation of reading the digital image data signal when a predetermined number of pulses in said first clock pulse signal is inputted into said source drivers.

3. The drive circuit of a display unit according to claim 1, wherein said control circuit has a clock control circuit into which said first clock pulse signal and said second clock pulse signal are externally inputted and then which generates the clock signals.

4. The drive circuit of a display unit according to claim 1, wherein said control circuit has a clock control circuit into which said first clock pulse signal and said second clock pulse signal are externally inputted and then which generates two kinds of clock signals which are different in phase from each other.

5. The drive circuit of a display unit according to clam 1, wherein said control circuit has a clock control circuit into which said first clock pulse signal is inputted from an external circuit and generates said clock signal from said first clock pulse signal, and said clock control circuit comprises:

a frequency converter circuit being inputted said first clock pulse signal and converting the frequency of said first clock pulse signal to generate said second clock pulse signal;

a selector circuit being inputted said first clock pulse signal and said second clock pulse signal and selecting said first clock pulse signal and said second clock pulse signal in said reading period and said transferring period, respectively; and an output circuit for outputting said first clock pulse signal or said second clock pulse signal selected by said selector circuit.

6. The drive circuit of a display unit according to claim 1, wherein the control circuit has a clock control circuit into which said second clock pulse signal is inputted from an external circuit and generates said clock signal from said second clock pulse signal, and said clock control circuit comprises:

a frequency converter circuit being inputted said second clock pulse signal and converting the frequency of said second clock pulse signal to generate said first clock pulse signal;

a selector circuit being inputted said first clock pulse signal and said second clock pulse signal and selecting said first clock pulse signal and said second clock pulse signal in said reading period and said transferring period, respectively; and an output circuit for outputting said first clock pulse signal or said second clock pulse signal selected by said selector circuit.

7. The drive circuit of a display unit according to clam 1, wherein the control circuit has a clock control circuit into which a clock pulse signal at predetermined frequency is inputted from an external circuit, and said clock control circuit comprises:

a frequency raising circuit having a phase locked loop (PLL) being inputted said clock pulse signal, converting the frequency of said clock pulse signal and generating said first clock pulse signal;

a frequency lowering circuit having a divider circuit being inputted said clock pulse signal, converting the frequency of said clock pulse signal and generating said second clock pulse signal;

a selector circuit being inputted said first clock pulse signal and said second clock pulse signal and selecting said first clock pulse signal and said second clock pulse signal in said reading period and said transferring period, respectively; and an output circuit for outputting said first clock pulse signal or said second clock pulse signal selected by said selector circuit.

8. The drive circuit of a display unit according to clam 1, wherein said control circuit outputs said clock signals and digital image data signals whose power amplitudes are lower than that of said start pulse signal.

9. The drive circuit of a display unit according to clam 5, wherein said frequency converter circuit is a frequency raising circuit having a phase locked loop (PLL).

10. The drive circuit of a display unit according to clam 6, wherein said frequency converter circuit is a frequency lowering circuit having a divider circuit.

11. The drive circuit of a display unit according to clam 8, wherein said control circuit has three kinds or more of power supply lines whose potentials are different from each other, and an output buffer circuit which combines the power source lines to output said clock signals and digital image data signals having voltage amplitudes that are lower than that of said start pulse signal.

* * * * *